US005619828A

United States Patent [19]

Ver Meer

[11] Patent Number: 5,619,828

[45] Date of Patent: Apr. 15, 1997

[54] INSTALLATION FIN FOR WINDOWS AND DOORS

[75] Inventor: Jim Ver Meer, Pella, Iowa

[73] Assignee: Pella Corporation, Pella, Iowa

[21] Appl. No.: 359,288

[22] Filed: Dec. 19, 1994

[51] Int. Cl.[6] ..... E06B 1/04

[52] U.S. Cl. ..... 52/213; 52/204.1; 29/897.312; 72/703

[58] Field of Search ..... 72/703; 29/897.312; 52/204.1, 213, 217, 631, 658

[56] References Cited

U.S. PATENT DOCUMENTS

| | | | |
|---|---|---|---|
| 1,048,988 | 12/1912 | Mayo, Sr. . | |
| 1,995,764 | 3/1935 | Bohnsack . | |
| 2,249,257 | 7/1941 | Rumney et al. . | |
| 2,256,548 | 9/1941 | Chaffee . | |
| 2,773,571 | 12/1956 | Kelly . | |
| 2,826,282 | 3/1958 | Goldberg . | |
| 2,860,744 | 11/1958 | Mascari . | |
| 2,866,527 | 12/1958 | Schilling . | |
| 2,902,727 | 9/1959 | Samolis . | |
| 2,912,078 | 11/1959 | Kiehl . | |
| 3,057,444 | 10/1962 | Walberg . | |
| 3,093,217 | 6/1963 | Doede . | |
| 3,208,564 | 9/1965 | Sitterly . | |
| 3,451,168 | 6/1969 | Pengelly . | |
| 3,724,136 | 4/1973 | Forsberg . | |
| 3,911,554 | 10/1975 | Ford | 52/631 X |
| 3,969,868 | 7/1976 | Bainter | 52/631 X |
| 4,073,177 | 2/1978 | Leroux | 52/658 X |
| 4,179,849 | 12/1979 | Kuffner . | |
| 4,272,931 | 6/1981 | Stanizzo . | |
| 4,287,658 | 9/1981 | Egerer | 72/191 X |
| 4,299,060 | 11/1981 | Tippmann . | |
| 4,574,553 | 3/1986 | Liscc | 52/658 |
| 4,597,232 | 7/1986 | Lingemann | 52/658 X |
| 4,619,092 | 10/1986 | Kaminaga . | |
| 4,628,648 | 12/1986 | Winyard . | |
| 4,782,630 | 11/1988 | Kleyn . | |
| 4,787,184 | 11/1988 | Boidron . | |
| 4,791,758 | 12/1988 | Bauer . | |
| 4,809,469 | 3/1989 | Klein . | |
| 4,972,640 | 11/1990 | DeFazio . | |
| 4,981,001 | 1/1991 | Furuminato . | |
| 4,999,957 | 3/1991 | Kessler | 52/213 |
| 5,058,344 | 10/1991 | Biebuyck . | |
| 5,119,609 | 6/1992 | Tait et al. | 52/213 |
| 5,210,986 | 5/1993 | Hagemeyer et al. . | |
| 5,285,606 | 2/1994 | Hagemeyer . | |
| 5,299,396 | 4/1994 | Raap et al. . | |
| 5,299,399 | 4/1994 | Baier et al. . | |
| 5,325,579 | 7/1994 | Baier . | |
| 5,345,722 | 9/1994 | McKann . | |

FOREIGN PATENT DOCUMENTS

| | | |
|---|---|---|
| 2045765 | 12/1992 | Canada . |
| 0399778 | 5/1990 | United Kingdom . |

*Primary Examiner*—Carl D. Friedman
*Assistant Examiner*—Beth Aubrey
*Attorney, Agent, or Firm*—Hovey, Williams, Timmons & Collins

[57] ABSTRACT

Improved installation fins (28, 76) for window or door assemblies (88, 98) are provided which include structure (46) defining an elongated fold line (73) in the fins (28, 76). The structure (46) includes a plurality of elongated, discrete, parallel, aligned depressions (48) formed in one face (38) of the fin (28 76); the depressions (48) are oriented with the longitudinal axes thereof at an oblique angle of from about 10°–40° relative to the longitudinal axis of the fin (28, 76). The fins (28, 76) are preferably fabricated from aluminum, and the depressions (48) are formed therein by knurling.

58 Claims, 4 Drawing Sheets

INSTALLATION FIN FOR WINDOWS AND DOORS

BACKGROUND OF THE INVENTION

1. Field of the Invention

The present invention is broadly concerned with improved, bendable installation fins adapted for securement to window or door assemblies to facilitate site installation thereof in a building wall. More particularly, the invention pertains to a preferably aluminum installation fin having a fold line therein formed by a plurality of elongated, aligned, obliquely oriented depressions formed in one face of the fin body, as well as a method of forming such fold line structure through the use of a knurling wheel. Installation fins in accordance with the invention are lower in cost, retain their integrity through multiple bend cycles, and completely eliminate the apertures of prior fins, which require separate application of sealing tape and can lead to water leakage around the window or door frame during use.

2. Description of the Prior Art

Most commercial fenestration products (e.g., doors and windows) are provided with factory-installed circumscribing frames. These frames are normally equipped with elongated installation fins which are initially attached in a recessed or flattened condition adjacent the outer frame surfaces. In use, the fins are manually pivoted outwardly through essentially a 90° arc so as to form outwardly extending projections about the door or window frame. During installation, the window or door assembly is mounted in an appropriate rough opening in the building wall, and nails or screws are installed through the fins to attach the door or window assembly in place.

A common fin design uses a dual durometer plastic material where a soft material is used to allow folding of the fin. Such synthetic resin fins have the drawback of becoming brittle in cold weather and being perceived as being lesser quality than metal fins. Another fin design is described in U.S. Pat. No. 5,210,986 wherein aluminum fins are provided. These fins are designed with a fold line to make the fin manually bendable on-site. In particular, the '986 fins have a series of small holes punched in the fin bodies to define the necessary fold line. The holes are in turn covered with a tape which is designed to prevent water leakage through the holes when the fenestration product is installed in a building. Although fins produced in accordance with this patent are a significant advance in the art, one drawback is that the sealing tape is expensive and therefore the fins are not as economical to manufacture as one-piece metal fins. Furthermore, the sealing tape can become punctured or dislodged during the installation process, thereby presenting a potential leakage problem.

There is therefore a need in the art for an improved installation fin which is of essentially one-piece, integral design and which avoids the costs and problems associated with fold line structure in the form of tape-covered apertures through the fin body.

SUMMARY OF THE INVENTION

The present invention overcomes the problems outlined above, and provides an installation fin adapted for attachment to the frame of a fenestration product such as a framed door or window. Broadly speaking, the installation fin of the invention is in the form of an elongated fin body (preferably, although not necessarily, formed of a metal such as aluminum) presenting a pair of opposed faces as well as a pair of elongated, opposed, spaced apart, inner and outer side margins, with the inner side margin including structure for attachment of the fin to the frame of a fenestration product. The overall fin further includes structure defining an elongated fold line generally parallel with and proximal to the inner side margin for permitting selective pivotal movement of an outer section of the fin body about the fold line. The fold line-defining structure of the invention comprises a plurality of elongated, aligned depressions formed in at least one face of the body, these depressions being oriented with the longitudinal axes thereof at an oblique angle relative to the longitudinal axis of the body. In this fashion, the fin is provided with a fold line which is economical to produce and does not suffer from the problems associated with through apertures.

In preferred forms, the fin depressions are discrete and axially spaced from each other along the length of the body. They are normally oriented at an angle of from about 10°–40° relative to the longitudinal axis of the fin body, and more preferably at an angle of from about 15°–25°. In practice, the fin depressions are formed through the use of an appropriately configured knurling wheel allowing rapid, economical production.

Figures 2, 3, 4, 5:
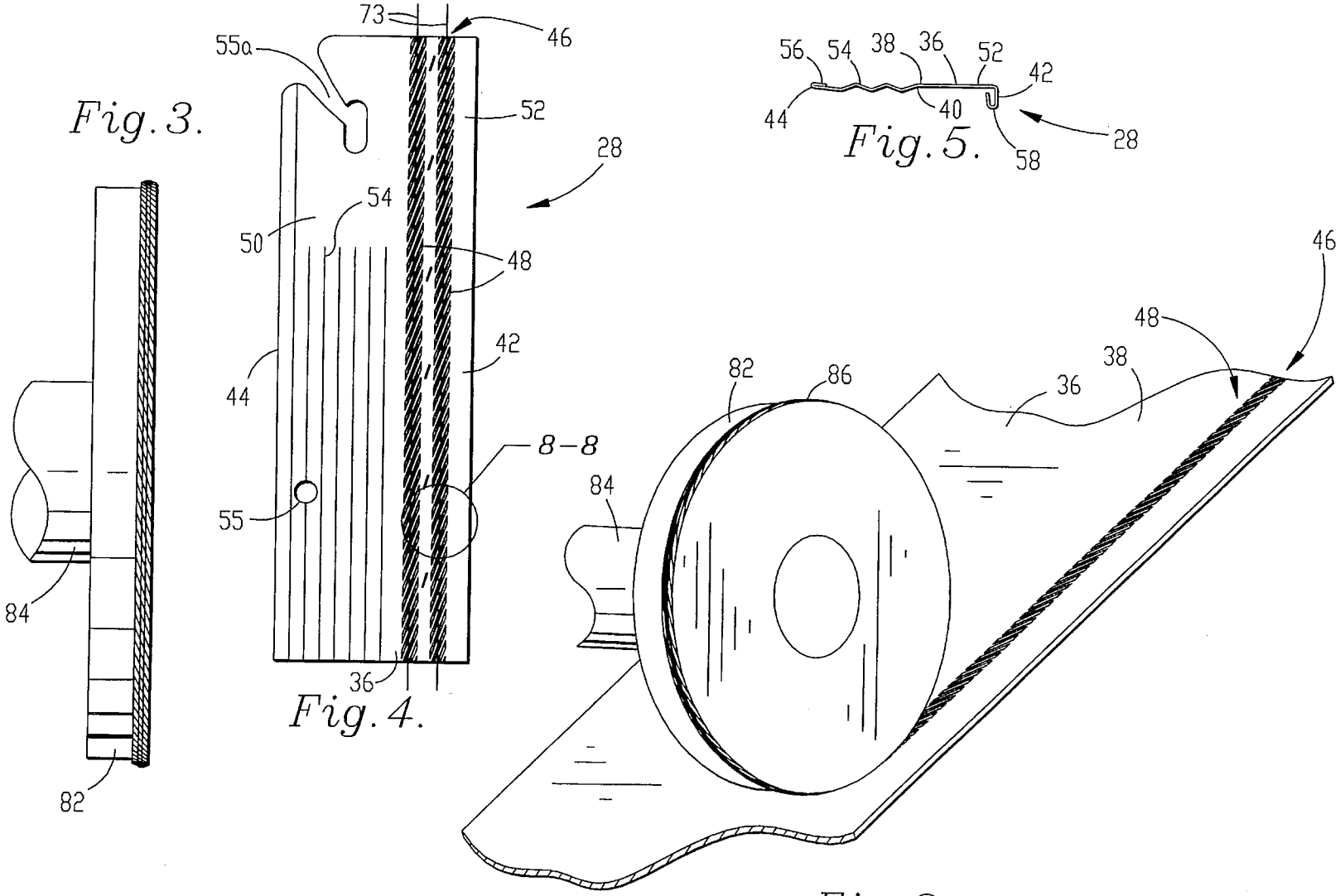
FIG. 2 is a fragmentary, essentially schematic, isometric view illustrating the use of a knurling wheel in the production of installation fins in accordance with the invention.
FIG. 3 is an end elevational view of the preferred knurling wheel used in the production of the installation fins of the invention.
FIG. 4 is an elevational view of an installation fin pursuant to the invention, depicting the fact thereof provided with the oblique, fold line-defining knurled depressions.
FIG. 5 is an end view of one installation fin in accordance with the invention, as illustrated in FIG. 4.
Figure 8:
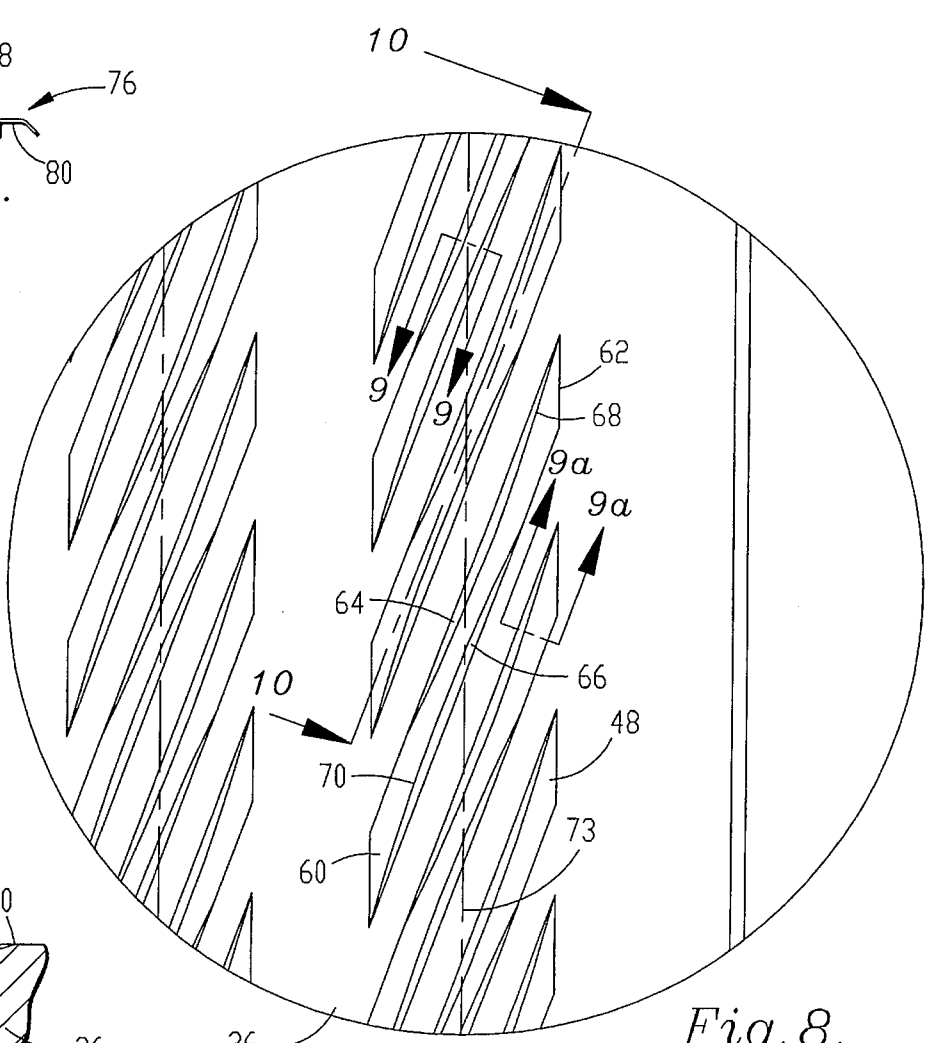
FIG. 8 is a greatly enlarged view illustrating the encircled portion of FIG. 4 and depicting in detail the configuration of the knurled depressions formed in the fin body.
Figure 7:
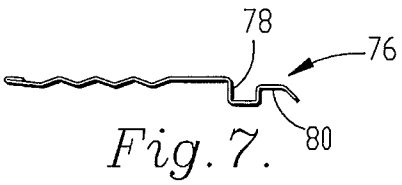
FIG. 7 is an end view illustrating the construction of the fin depicted in FIG. 6.
Figure 10:
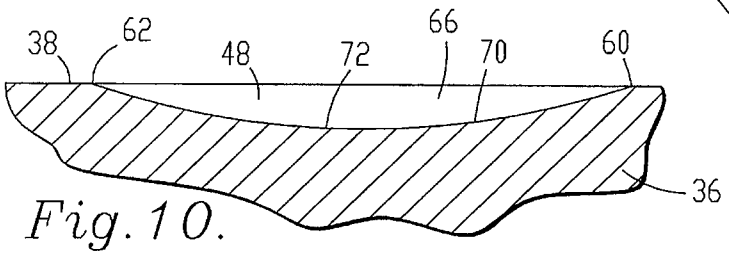
Figure 6:
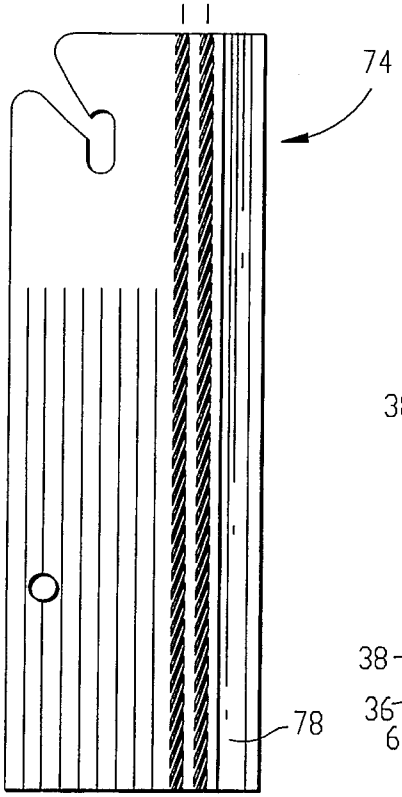
FIG. 6 is a view similar to that of FIG. 4, but depicting another type of installation fin in accordance with the invention.
Figure 11:
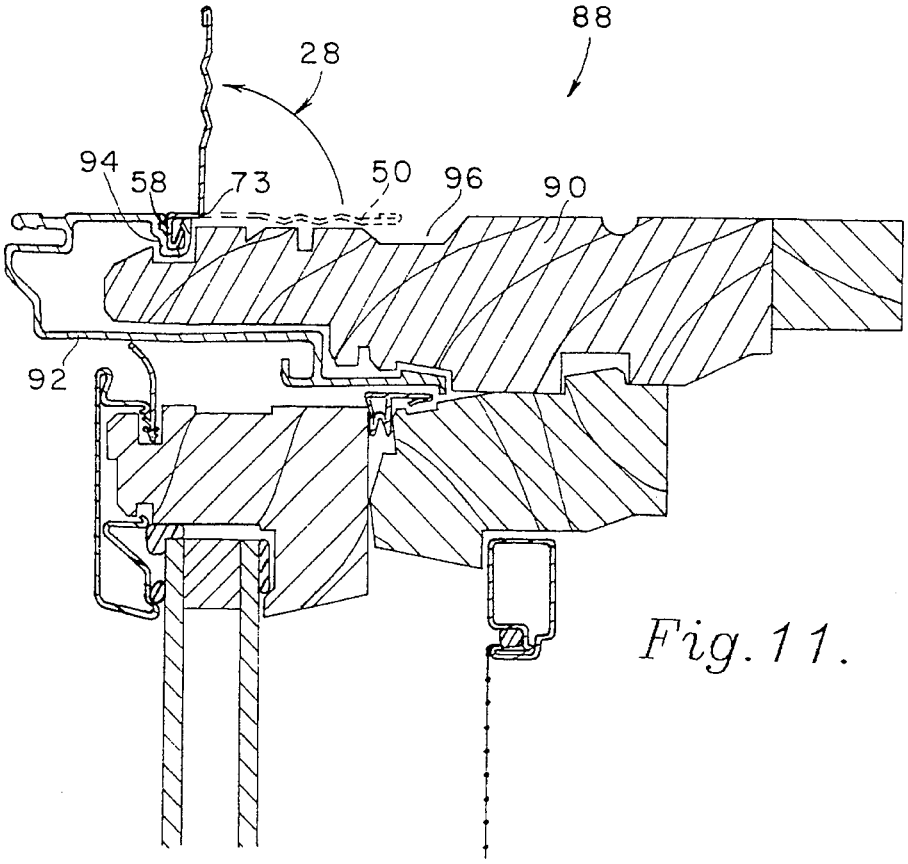
Figure 12:
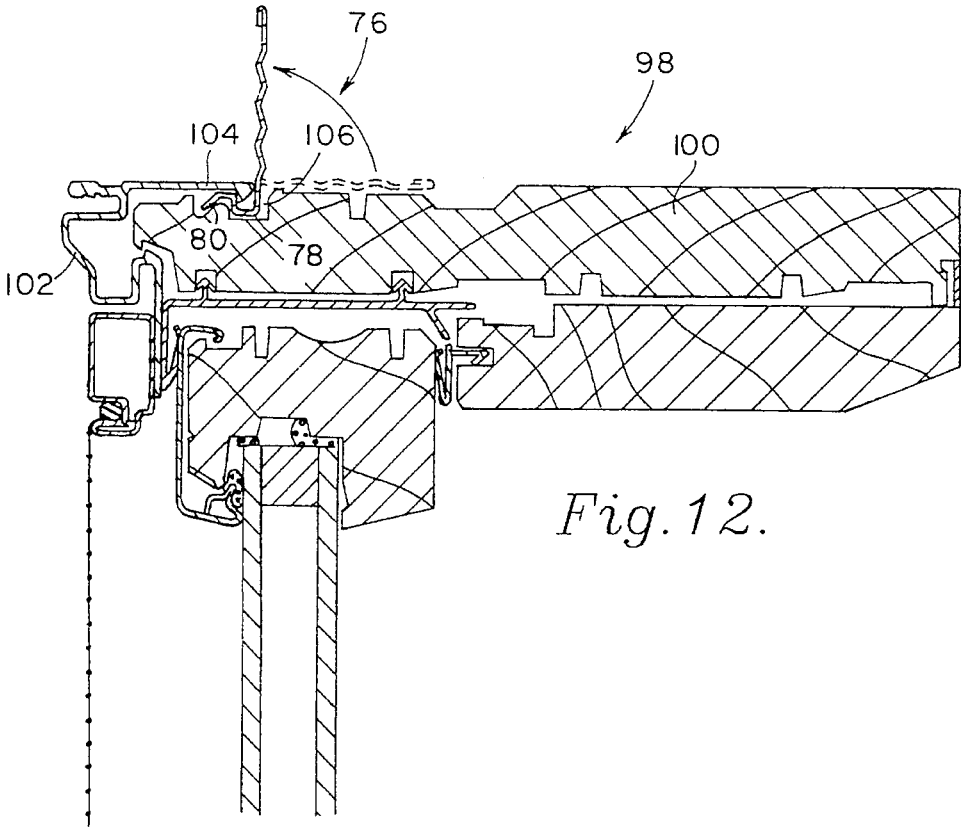

FIG. *9a* is a sectional view taken along line *9a—9a* of FIG. 8 and illustrating the configuration of a depression at a point adjacent an end margin thereof;

FIG. 10 is a sectional view taken along line 10—10 of FIG. 8 and further depicting the configuration of a fin depression;

FIG. 11 is a fragmentary vertical sectional view illustrating a window assembly in accordance with the invention, equipped with the installation fin of FIGS. 4–5, and wherein the shipping condition of the fin is illustrated in phantom and the use position thereof is shown in full lines; and FIG. 12 is a view similar to that of FIG. 11 but illustrating use of the installation fin of FIGS. 6–7.

DETAILED DESCRIPTION OF THE PREFERRED EMBODIMENT

Figure 1:
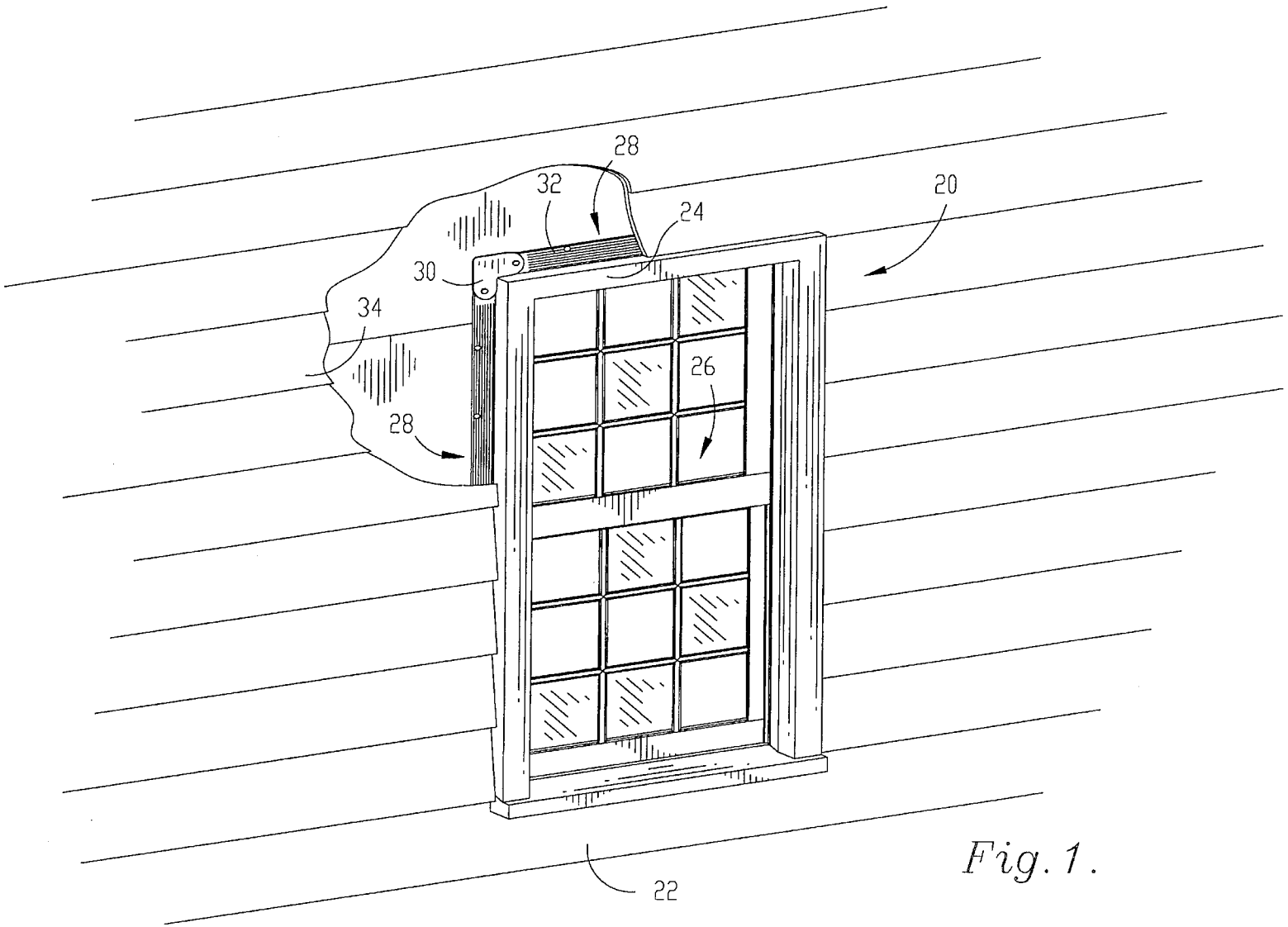
FIG. 1 is an isometric view with parts broken away illustrating an installed window assembly in accordance with the invention, making use of the improved installation fins hereof.

Turning now to the drawings, and particularly FIG. 1, a window assembly 20 is illustrated in an installed condition within a building wall 22. Broadly, the assembly 20 includes a circumscribing frame 24 operably supporting a conventional window 26 therein. A total of four installation fins 28 are respectively attached to the frame 24, with the corners of the individual fins 28 being interconnected by corner connectors 30 of known design. As illustrated, the assembly 20 is attached to wall 22 by fasteners 32 (i.e., screws or nails) passing through the installation fins 28 and into the wall structure. Thereafter, exterior siding 34 is applied to the wall 22 in order to finish the window installation and cover the fins 28 and related structure.

Attention is next directed to FIGS. 4, 5 and 8–10 which illustrate in detail the construction and design of the installation fins 28. As shown in FIGS. 4–5, the fin 28 is in the form of an elongated, integral aluminum (preferably 0.0235 gauge Type 3105 aluminum) body 36 presenting opposed upper and lower faces 38, 40 as well as inner and outer side margins 42, 44. The fin 28 further includes fold line-defining structure 46 in the form of a series of elongated, aligned, obliquely oriented knurl-formed depressions 48. The depressions 48 serve to divide the fin body into an outer section 50 as well as an inner section 52.

Outer section 50 includes a series of elongated, axially extending, generally chevron-shaped corrugations 54 extending along the length of the body 36. The section 54 terminates in a reverse bend 56 serving to strengthen the outer side margin 44. The outer section 50 also has a series of fastener-receiving openings 55 therethrough, and the end corners of the section 50 have keyways **55*a* allowing interconnection of the connectors 30 described previously. The inner section 52 includes a generally U-shaped connection portion 58 (see FIG. 5**) which is designed to mate with corresponding connection structure on a window or door frame.

Figure 9A:
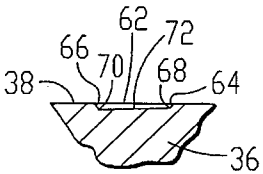
FIG. 9 is a sectional view taken along line 9—9 of FIG. 8 and illustrating the cross-sectional configuration of one of the depressions at essentially its deepest point.
Figure 9:
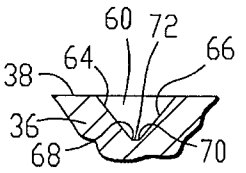

Attention is next directed to FIGS. 8–10 which illustrate in detail the location and geometry of the individual depressions 48. It will be observed that the depressions 48 are discrete, substantially parallel, and axially spaced from each other along the length of body 36. Preferably, these depressions are spaced apart a center-to-center distance of from about 0.07 to 0.26 inches, and more preferably from about 0.10 to 0.17 inches. Moreover, they are oriented with the longitudinal axes thereof at an angle of from about 10°–40° relative to the longitudinal axis of body 36, and more preferably at an angle of from about 15°–25°; the most preferred angle of orientation is about 20°. Each of the depressions 48 advantageously has a length of from about 0.19 to 0.72 inches, and more preferably from about 0.29 to 0.48 inches.

Referring specifically to FIGS. 8–10, it will be observed that each depression 48 presents a pair of end margins 60, 62 which are transverse to the longitudinal axis of the corresponding depression and essentially parallel with the longitudinal axis of body 36. Moreover, each depression 48 presents a pair of elongated, opposed sidewall surfaces 64, 66 extending downwardly from upper face 38 and terminating in corresponding arcuate inboard margins 68, 70. A bottom surface 72 extends between the depression end margins 60, 62 and between the inboard sidewall surface margins 68, 70.

It will be seen (FIG. 10) that bottom surface 72 is generally arcuate along the length thereof between the end margins 60, 62. The maximum depth of each depression 48 relative to upper face 38 is at the central region of the depression intermediate the end margins. This maximum depth is preferably from about 0.15 to 0.21 inches, and more preferably from about 0.17 to 0.19 inches; in commercial practice, the depth is 0.018 inches. It will also be seen that the sidewalls 64, 66 are obliquely oriented relative to upper face 38 and as indicated present arcuate inboard bottom margins 68, 70. Thus, in plan configuration, each of the inboard bottom margins 68, 70 has an inwardly extending maximum and tapers therefrom toward the opposed end margins 60, 62 of the depression 48. The inwardly extending maximums of adjacent inboard bottom margins are offset from each other as is clearly evident from a study of FIG. 8. FIGS. 9 and **9*a* further illustrate the end-to-end arcuate nature of the depressions 48**.

In one form of the invention, the depressions 48 are formed in only one face of body 36, i.e., the upper face 38 thereof. Moreover, the depressions extend only partially through the thickness of the body 36. In this respect, the body normally has a thickness of from about 0.018 to 0.036 inches, and more preferably from about 0.022 to 0.026 inches.

Again referring to FIG. 8, it will be seen that the aligned depressions 48 cooperatively define an elongated, axially extending fold line 73. The provision of fold line 73 thus permits outer body section 50 to be pivoted generally about line 73 when the fin 28 is attached to a window or door frame. It is desired that the section 50 be bendable through a 90° arc for a minimum of three cycles, and that a 6-inch length of the fin be bendable with less than 15 in. lb. of torque.

In another form of the invention, depressions 48 are formed on both faces of body 36 in registration with one another so that the thinnest part of body 36 is between opposed depressions 48. With this configuration, the individual depressions do not need to be as deep in order to form the desired fold line 73.

In another aspect of the invention, two fold lines 73 are defined side-by-side. This allows the installer to select one of the two fold lines for bending thereat to provide some adjustment capability concerning the depth of the fit of the window or door. For example, with the two fold lines spaced at ¼ inch on center, ¼ inch of depth selection would be available to the installer. In order to ensure that fin 28 folds at the selected fold line 73, a tool or brace can be provided to prevent bending at one of the fold lines while allowing bending at the other. Alternatively, spaced staples can be placed between the fold lines. With the staples in place, folding would occur at the outer fold line. With staples removed, bending would occur at the inner fold line.

Attention is next directed to FIGS. 6–7 which illustrate another installation fin 74. This fin is identical in all respects with fin 28, except for the particular design of the inner margin frame attachment structure 76. That is, as best seen in FIG. 7, the attachment structure in this instance includes an upwardly opening, generally U-shaped channel 78 with a laterally extending tail piece 80 extending from channel 78 at a point remote from the main body of the fin. Here again, this attachment structure 76 is designed to mate with corresponding structure provided on the window or door frame. In all other respects, and particularly the fold line-defining depressions, the embodiment of FIGS. 6–7 is identical with that of FIGS. 4–5.

FIG. 3 illustrates a knurling wheel 82 designed for use in the production of installation fins in accordance with the invention. The wheel 82 includes a mounting shaft 84 and has, about the periphery thereof, 120 depression-forming chamfered teeth 86, oriented at a tooth angle of 70° across the wheel and a tooth point (grinding wheel angle) of 45°, and with a 0.005: flat on top of each tooth. The teeth 86 have a depth of 0.030 inch. These teeth are of course designed and oriented to produce the corresponding depressions 48 in a fin body during production thereof. As shown in FIG. 2, the preferred production technique involves passing a fin body 36 under the rotating knurling wheel 82 thereby forming the aligned depressions 48 in face 38 of the body.

FIG. 11 illustrates an otherwise conventional casement window assembly 88 equipped with installation fins 28 described previously. The assembly 88 includes a circumscribing frame 90 which normally is clad with aluminum 92. In the illustrated embodiment, the frame member includes an extrusion 92 presenting an elongated, outwardly opening connection channel 94 of generally U-shaped configuration. The connection portion 58 of fin 28 is designed to be snapped into the channel 94 and to be retained therein by an interference fit. The initial production and shipping condition of fin 28 is illustrated in phantom in FIG. 11. As shown, the outer section 50 thereof is disposed essentially against the outer surface of the frame member, and the latter includes a finger recess 96 to allow easy access to the fin section 50. During installation of the assembly 88, the outer fin section 50 is pivoted outwardly through essentially a 90° arc about fold line 73 to assume the projecting, full line position depicted in FIG. 11. Of course, the other fins attached to the remaining frame members would be similarly pivoted. At this point, the window assembly 88 is placed within a previously prepared rough opening in a building wall, and fasteners are passed through the installation fins to install the assembly 88 in place.

FIG. 12 illustrates a sliding window assembly 98 which likewise includes an upper frame member 100 provided with an extrusion 102. The latter includes a rearwardly extending retainer 104, whereas the adjacent underlying portion of the frame member has an elongated, recess 106 formed therein. In this instance, the installation fin 76 is attached to the assembly 98, through the illustrated interfitting of channel 78 and tail piece 80 with recess 106 and retainer 104. Again, the shipping position of the fin is illustrated in phantom, whereas the outwardly pivoted use position is shown in full lines.

I claim:

1. An installation fin adapted for attachment to the frame of a fenestration product and comprising:

an elongated thin body presenting a pair of opposed faces and a pair of elongated, opposed, spaced apart, inner and outer side margins, said inner side margin including structure for attachment of the fin to said fenestration product; and structure defining an elongated fold line generally parallel with and proximal to said inner side margin for permitting selective pivotal movement of an outer section of the fin body about the fold line, said fold line-defining structure including a plurality of elongated, aligned depressions formed in at least one face of said body, said depressions being oriented with the longitudinal axes thereof at an oblique angle relative to the longitudinal axis of said body to cooperatively define said fold line, said depressions being discrete and axially spaced from each other.

2. The fin of claim 1, said depressions extending along the length of said body.

3. The fin of claim 2, said depressions being spaced apart a distance of from about 0.07 to 0.026 inches.

4. The fin of claim 3, said distance being from about 0.10 to 0.17 inches.

5. The fin of claim 1, said depressions being oriented with the longitudinal axes thereof at an angle of from about 10° to 40° relative to the longitudinal axis of said body.

6. The fin of claim 5, said angle being from about 15° to 25°.

7. The fin of claim 1, said depressions being substantially parallel with each other.

8. The fin of claim 1, said depressions having a length of from about 0.19 to 0.72 inches.

9. The fin of claim 8, said length being from about 0.29 to 0.48 inches.

10. The fin of claim 1, each of said depressions presenting a pair of opposed ends, a pair of elongated, opposed sidewall surfaces extending downwardly from said one surface and terminating in inboard margins, and a bottom surface extending between said ends and between said inboard margins of said sidewall surfaces.

11. The fin of claim 1, said surface bottom being generally arcuate along the length thereof.

12. The fin of claim 11, the maximum depth of the depressions relative to said one face being at the central region of the depressions intermediate said ends.

13. The fin of claim 12, said maximum depth being from about 0.15 to 0.21 inches.

14. The fin of claim 13, said depth being from about 0.17 to 0.19 inches.

15. The fin of claim 10, said ends presenting elongated end margins transverse to the longitudinal axes of the corresponding depressions.

16. The fin of claim 10, each of said sidewall surfaces presenting a portion which is obliquely oriented relative to said one face and having arcuate inboard bottom margins.

17. The fin of claim 16, each of said arcuate inboard bottom margins having an inwardly extending maximum and tapering therefrom towards said opposed ends.

18. The fin of claim 17, the maximums of opposed arcuate inboard bottom margins being offset from each other.

19. The fin of claim 1, said depressions being formed in only one face of said body.

20. The fin of claim 1, said depressions extending only partially through the thickness of said body.

21. The fin of claim 1, said body being formed of aluminum.

22. The fin of claim 1, said body having a thickness of from about 0.018 to 0.036 inches.

23. The fin of claim 22, said thickness being from about 0.022 to 0.026 inches.

24. The fin of claim 1, said body having a series of elongated, adjacent, generally chevron-spaced corrugations spaced laterally from said inner side margin and fold line defining structure.

25. The fin of claim 1, said inner side margin including an elongated channel-defining section formed along said body inner side margin.

26. The fin of claim 1 including a plurality of said fold lines on one of said faces and spaced apart for permitting said pivotal movement about a selected one of said fold lines.

27. The fin of claim 1 including a pair of said fold lines respectively aligned with one another on opposed faces of said body.

28. The fin of claim 27, wherein said depressions on said fold lines are in registration with one another on opposed faces of said body.

29. A fenestration assembly adapted to be mounted in an opening in a wall of a building and comprising:

a frame assembly presenting at least a top and opposite side members, each of said members having an outer surface;

a fenestration product within the confines of said frame assembly and operably coupled thereto; and an elongated installation fin secured to the outer surface of said top and side frame members, each of said fins including an elongated, thin body presenting a pair of opposed faces and a pair of elongated opposed inner and outer side margins, said inner side margin being secured to a corresponding frame member; and structure defining an elongated fold line generally parallel with and proximal to said inner side margin for permitting selective pivotal movement of an outer section of the fin body about the fold line and away from adjacent frame member, said fold line-defining structure including a plurality of elongated, aligned depressions formed in at least one face of said body, said depressions being oriented with the longitudinal axes thereof at an oblique angle relative to the longitudinal axis of said body to cooperatively define said fold line, said depressions being discrete and axially spaced from each other.

30. The fenestration assembly of claim 29, said depressions extending along the length of said body.

31. The fenestration assembly of claim 29, said depressions being spaced apart a distance of from about 0.07 to 0.26 inches.

32. The fenestration assembly of claim 31, said distance being from about 0.10 to 0.17 inches.

33. The fenestration assembly of claim 29, said depressions being oriented with the longitudinal axes thereof at an angle of from about 10° to 40° relative to the longitudinal axis of said body.

34. The fenstration assembly of claim 33, said angle being from about 15° to 25°.

35. The fenestration assembly of claim 29, said depressions being substantially parallel with each other.

36. The fenestration assembly of claim 29, said depressions having a length of from about 0.19 to 0.72 inches.

37. The fenestration assembly of claim 36, said length being from about 0.29 to 0.48 inches.

38. The fenestration assembly of claim 29, each of said depressions presenting a pair of opposed ends, a pair of elongated, opposed sidewall surfaces extending downwardly from said one surface and terminating in inboard margins, and a bottom surface extending between said ends and between said inboard margins of said sidewall surfaces.

39. The fenestration assembly of claim 29, said surface bottom being generally arcuate along the length thereof.

40. The fenestration assembly of claim 39, the maximum depth of the depressions relative to said one face being at the central region of the depressions intermediate said ends.

41. The fenestration assembly of claim 40, said maximum depth being from about 0.15 to 0.21 inches.

42. The fenestration assembly of claim 41, said depth being from about 0.17 to 0.19 inches.

43. The fenestration assembly of claim 38, said ends presenting elongated end margins transverse to the longitudinal axes of the corresponding depressions.

44. The fenestration assembly of claim 38, each of said sidewall surfaces presenting a portion which is obliquely oriented relative to said one face and having arcuate inboard bottom margins.

45. The fenestration assembly of claim 44, each of said arcuate inboard bottom margins having an inwardly extending maximum and tapering therefrom towards said opposed ends.

46. The fenestration assembly of claim 45, the maximums of opposed arcuate inboard bottom margins being offset from each other.

47. The fenestration assembly of claim 29, said depressions being formed in only one face of said body.

48. The fenestration assembly of claim 29, said depressions extending only partially through the thickness of said body.

49. The fenestration assembly of claim 29, said body being formed of aluminum.

50. The fenestration assembly of claim 29, said body having a thickness of from about 0.018 to 0.036 inches.

51. The fenestration assembly of claim 50, said thickness being from about 0.022 to 0.026 inches.

52. The fenestration assembly of claim 29, said body having a series of elongated, adjacent, generally chevron-spaced corrugations spaced laterally from said inner side margin and fold line defining structure.

53. The fenestration assembly of claim 29, said inner side margin including an elongated channel-defining section formed along said body inner side margin.

54. The fenestration assembly of claim 29, said fenestration product being a door or window.

55. The assembly of claim 29 including a plurality of said fold lines on one of said faces and spaced apart for permitting said pivotal movement about a selected one of said fold lines.

56. The assembly of claim 29 including a pair of said fold lines respectively aligned with one another on opposed faces of said body.

57. The assembly of claim 56, wherein said depressions on said fold lines are in registration with one another on opposed faces of said body.

58. In a metallic body presenting opposite faces and having structure defining an elongated fold line permitting selective pivoting of at least one body section about the fold line, improved fold line-defining structure comprising a plurality of elongated, aligned depressions formed in at least one face of said body and oriented with the longitudinal axes thereof at an oblique angle relative to said fold line, said depressions being discrete and axially spaced from each other.

* * * * *